US008675452B2

(12) United States Patent
Saunders et al.

(10) Patent No.: US 8,675,452 B2
(45) Date of Patent: Mar. 18, 2014

(54) SYSTEMS AND METHODS FOR TIMING ATHLETIC EVENTS

(75) Inventors: J. Lynn Saunders, Hillsboro, OR (US); Sarah J. Marlino, Hillsboro, OR (US); Philip S. Crosby, Portland, OR (US); Eric Christopher Carlson, Portland, OR (US)

(73) Assignee: Flashtiming LLC, Hillsboro, OR (US)

( * ) Notice: Subject to any disclaimer, the term of this patent is extended or adjusted under 35 U.S.C. 154(b) by 373 days.

(21) Appl. No.: 12/930,288

(22) Filed: Jan. 3, 2011

(65) Prior Publication Data

US 2012/0170427 A1 Jul. 5, 2012

Related U.S. Application Data

(63) Continuation-in-part of application No. 12/930,223, filed on Dec. 31, 2010.

(51) Int. Cl.
*G04F 8/00* (2006.01)
*G07C 1/24* (2006.01)

(52) U.S. Cl.
USPC ..... 368/3; 368/9; 368/113; 340/323 R; 348/157

(58) Field of Classification Search
USPC ..... 368/1, 2, 3, 9, 10, 110–113; 340/323 R; 348/157
See application file for complete search history.

(56) References Cited

U.S. PATENT DOCUMENTS

| | | | | |
|---|---|---|---|---|
| 4,523,204 | A * | 6/1985 | Bovay | 396/315 |
| 5,103,433 | A * | 4/1992 | Imhof | 368/9 |
| 5,293,354 | A * | 3/1994 | Costabile | 368/11 |
| 5,513,103 | A * | 4/1996 | Charlson | 700/93 |
| 5,657,077 | A * | 8/1997 | DeAngelis et al. | 348/157 |
| 5,805,210 | A * | 9/1998 | Sekiya et al. | 348/157 |
| 5,831,940 | A * | 11/1998 | Gillette | 368/3 |
| 6,369,697 | B1 * | 4/2002 | Poole | 340/573.1 |
| 6,542,183 | B1 * | 4/2003 | DeAngelis et al. | 348/159 |
| 6,545,705 | B1 * | 4/2003 | Sigel et al. | 348/157 |
| 2004/0104845 | A1 | 6/2004 | McCarthy | |
| 2004/0184354 | A1 * | 9/2004 | McDonald | 368/3 |
| 2006/0064731 | A1 * | 3/2006 | Kahle et al. | 725/105 |
| 2007/0076528 | A1 * | 4/2007 | Kirby | 368/47 |
| 2008/0233551 | A1 * | 9/2008 | Doctoroff et al. | 434/352 |

OTHER PUBLICATIONS

U.S. Appl. No. 12/930,223, office action mailed Feb. 8, 2013 and amendment mailed May 8, 2013.

U.S. Appl. No. 12/930,223, office action mailed Sep. 6, 2013.

* cited by examiner

*Primary Examiner* — Vit W Miska

(74) *Attorney, Agent, or Firm* — Loudermilk Associates

(57) ABSTRACT

Improved systems and methods for timing athletic events. A radio-based starter unit and a radio based timer unit communicate wirelessly via radio. Push buttons/switches and lights and a speaker in the units provide an intuitive, easy to use interface. Handshaking occurs between the starter unit and the timer unit, and lights indicate that the event is ready to start. Real time clocks in the units are synchronized. Upon detection of race or other event start, such as from a starter's pistol, information indicative of the race start time is transmitted from the start unit to the timer unit. A camera in communication with the timer unit provides video frames, and the timer unit encodes and inserts elapsed time information in the video frames, which are then output from the timer unit for review and analysis on a computer.

25 Claims, 6 Drawing Sheets

FIG. 1
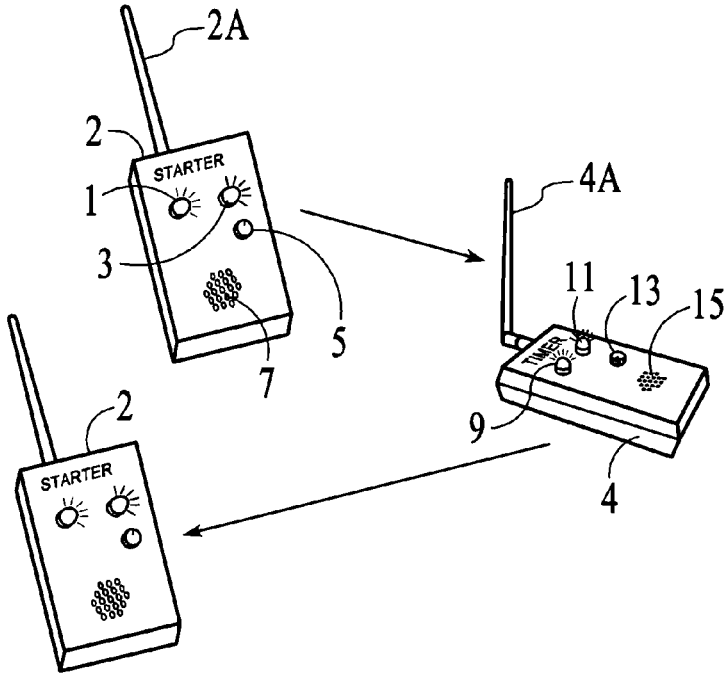
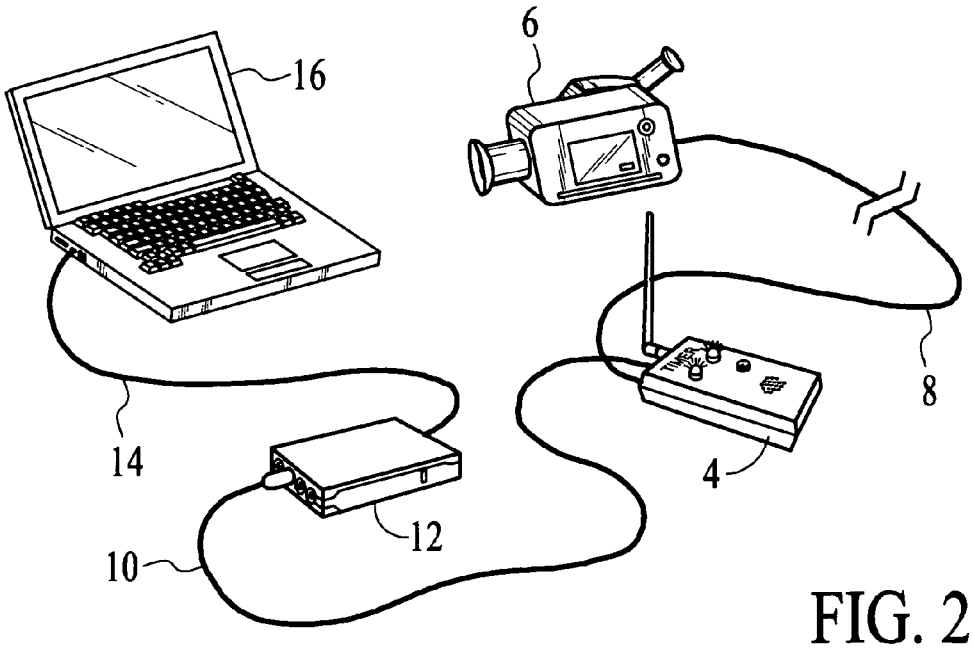
FIG. 2

SYSTEMS AND METHODS FOR TIMING ATHLETIC EVENTS

This application is a continuation-in-part of U.S. application Ser. No. 12/930,223 filed on Dec. 31, 2010.

FIELD OF THE INVENTION

The present invention relates to electronic timing systems for athletic events, such as track, swimming and other racing event and sports event, and more particularly to electronic systems and methods for timing automatically athletic or other events using radio controlled starting and timing units and one or more video cameras.

BACKGROUND OF THE INVENTION

Electronic systems and methods for timing athletic-events such as track or swimming performances are known in the art. One previous system is known as "Accutrack," which is sometimes referred to as a photo finish record system that produces a time sequence set of photographs of contestants crossing a line. Generally with such a system, a sound activated switch located on or near the starter detects the firing of the starter's gun, horn or other sound device. The switch may be coupled to the recording system with a wire, or a flash generating and detecting system may be used in order to eliminate the wire connection between the sound detecting device and the recording system.

Such conventional systems typically have been characterized by high cost (such as including expensive cabling or radio links to quickly communicate the time of the start of a race from the starting location to the finish location), or else have inconvenient user interfaces or human signaling or separate character recognition software or the like. What is needed are improved accurate, low cost, easy to use systems and methods for schools and other organizations that cannot afford currently available high end systems.

SUMMARY OF THE INVENTION

The present invention is directed to systems and methods that provide innovative and reduced cost fully automated timing for athletic or similar type events. With the present invention, radio-based starter and timer units, and a video camera and computer and associated software, fully automatic timing systems and methods are provided that are easy to use and that allow schools or other organizations to host a quality track meets, swimming events, etc., with accurate times and fast results.

In accordance with the present invention, the starter and timer units are radio controlled, so there is no need to wire the starter or point a timing device at the starter's pistol. This reduces the need for recalls due to difficult-to-aim timers missing the light from the starter's pistol. In addition, in preferred embodiments of the present invention, the starter and timer units provide built-in digital radio communication between the starting and timing officials. Everyone is ready when it is time to start the race due to the hardware semaphore system consisting of push buttons, lights, and sound, allowing officials at the start and at the timing station be in synchronized communication.

Also in accordance with the present invention, handshaking and clock synchronization are provided between the starter unit and the timer unit for accurate and convenient timing of events. Preferably, timing information is encoded in video frames from a camera for subsequent display and analysis on a capture computer. In preferred embodiments, after handshaking and clock synchronization, race start is detected by the starter unit, which then transmits the race start time to the timer unit, which uses the race start time and its own synchronized real time clock to determine elapsed race time for embedding into the video fields. Intuitive and easy to use buttons and lights allow the race officials to communicate wirelessly (via radios), so that sporting events may timed conveniently and accurately. Systems and methods in accordance with the present invention are video-based system preferably with accuracy to about 0.016 second and time reported in 1/1000 seconds. Optionally, video interpolation software may be utilized to provide more precise timing with conventional video systems.

Systems and methods in accordance with the present invention may be reliably triggered by a .22 or .32 caliber starting pistol or other sound implement with an acoustic sound detection circuit, so there is no special ammunition required. Alternatively, race/event starting may also be triggered by a normally open contact that is closed such as by button push.

In accordance with preferred embodiments, systems and methods preferably include intelligent radios for both the starter and timer units and software on a capture computer to capture and review videos. Finish line images of each race preferably are recorded every 1/60th of a second for photo finish results, which resolution may be increased optionally with video interpolation software. The race time is recorded (preferably encoded) on each frame of the video and is saved to a computer's hard drive. Playback of captured results is easy. Software preferably provides an easy to access file naming system for each heat or race event recorded. Optionally, event results may be transferred to event or meet management application software such as with a click of a mouse.

Accordingly, it is an object of the present invention to provide easy to use radio-based starter and timer units for starting athletic events and recording elapsed time on video frames of a camera near the finish line.

It is another object of the present invention to provide improved radio communications between the starter unit and the timer unit, preferably with improved handshaking.

It is yet another object of the present invention to provide improved timing of athletic events with synchronized clocks and transmission of event start from the starter unit to the timer unit to reduce latency concerns regarding the successful transmission of the race start to the timing unit and official.

It further is an object of the present invention to provide improved systems and methods for encoding timing information in video information, which may included encoded timing information in video frames and/or interpolated video frames.

Finally, it is an object of the present invention to provide improved systems and method for timing athletic events using conventional starting guns or other sound implements, with easy to use radio-based units for efficient communications between race officials and video cameras so that accurate timing systems may be utilized for schools and other organizations who could not previously afford such systems due to their high cost or complexity.

BRIEF DESCRIPTION OF THE DRAWINGS

The above objects and other advantages of the present invention will become more apparent by describing in detail the preferred embodiments of the present invention with reference to the attached drawings in which:

FIGS. 1 and 2 illustrate a preferred embodiment of a system in accordance with the present invention;

DETAILED DESCRIPTION OF EXEMPLARY PREFERRED EMBODIMENTS

Figure 3A:
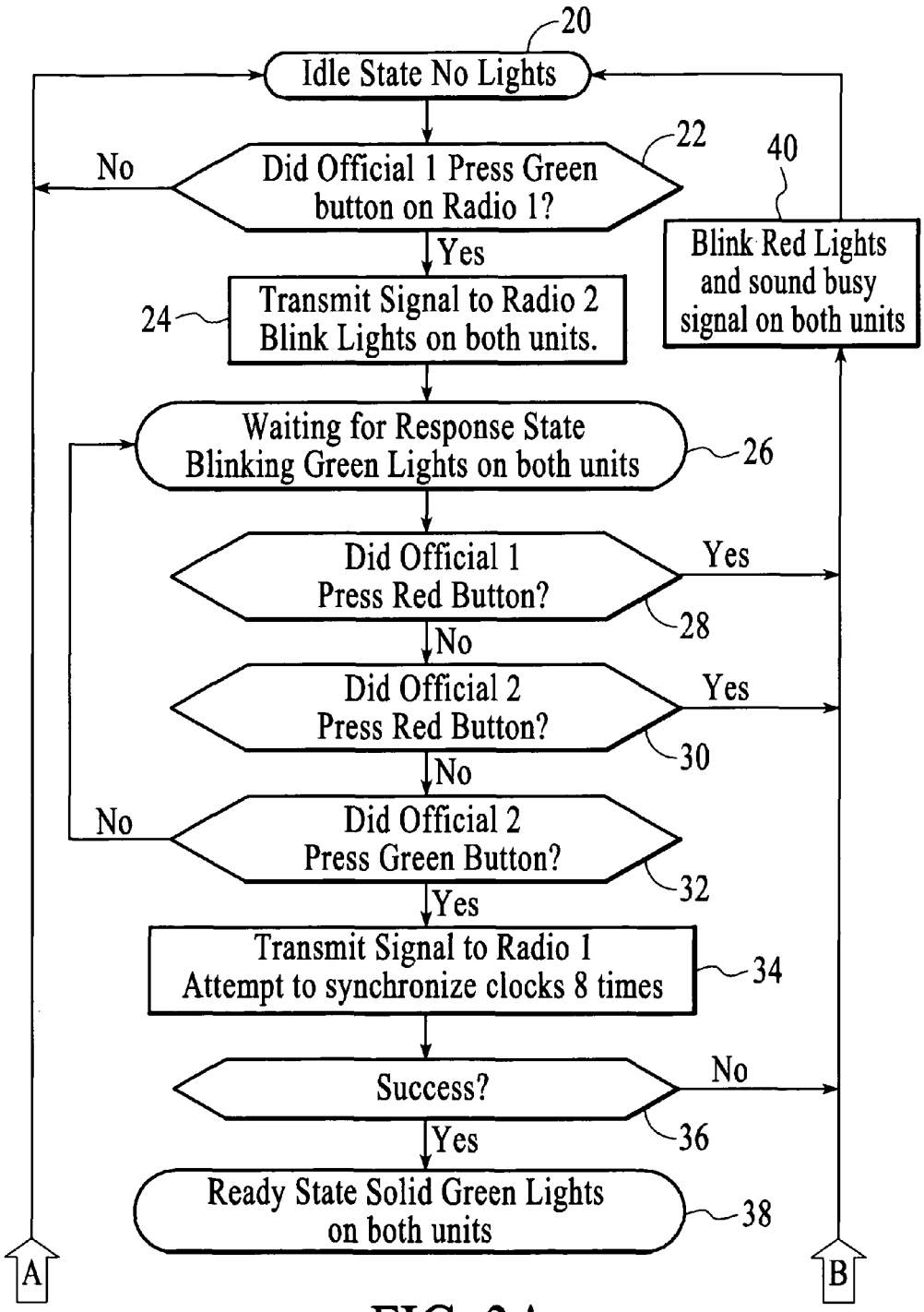
FIGS. 3A and 3B illustrate exemplary methods in accordance with preferred embodiments of the present invention.

The present invention will be described in greater detail with reference to certain preferred and alternative embodiments. As described below, refinements and substitutions of the various embodiments are possible based on the principles and teachings herein.

In accordance with preferred embodiments of the present invention, radio controlled, video-based systems and methods for fully automatic timing of athletic events are provided. Exemplary preferred embodiments of the present invention will now be described.

FIGS. 1 and 2 illustrate systems in accordance with exemplary preferred embodiments of the present invention. As illustrated in FIG. 1, starter unit 2 preferably includes ready button/light 1, with the light preferably consisting of an LED emitting green light. In preferred embodiments, ready button/light 1 is an integral unit that includes both a push button or other switch and an LED or other light source, preferably green in color; in alternative embodiments, a button/switch is provided with a separate LED or other light source. Also in preferred embodiments, starter unit 2 also preferably includes stop button/light 3, with the light preferably consisting of an LED emitting red light. In preferred embodiments, stop button/light 3 is an integral unit that includes both a push button or other switch and an LED or other light source, preferably red in color; in alternative embodiments, a button/switch is provided with a separate LED or other light source. Starter unit 2 includes antenna 2A for radio communications with timer unit 4, and speaker 7 for emitting sounds that convey messages or other status information to the starting official. Preferably, starter unit 2 includes channel selector switch 5 serving to provide a channel select capability for the radio unit included within starter unit 2. The radio unit within starter unit 2 preferably is capable of communicating over two, four, eight, sixteen or some other number of radio channels for communication with timer unit 4, which preferably is capable of communicating over the same radio channels as is starter unit 2.

Also as illustrated in FIG. 1, timer unit 4 preferably includes ready button/light 9, with the light preferably consisting of an LED emitting green light. In preferred embodiments, ready button/light 9 is an integral unit that includes both a push button or other switch and a LED or other light source, preferably green in color; in alternative embodiments, a button/switch is provided with a separate LED or other light source. Also in preferred embodiments, timer unit 4 also preferably includes stop button/light 11, with the light preferably consisting of an LED emitting red light. In preferred embodiments, stop button/light 11 is an integral unit that includes both a push button or other switch and a LED or other light source, preferably red in color; in alternative embodiments, a button/switch is provided with a separate LED or other light source. Timer unit 4 includes antenna 4A for radio communications with starter unit 2, and speaker 15 for emitting sounds that convey messages or other status information to the timing official. Preferably, timer unit 4 includes channel selector switch 13 serving to provide a channel select capability for the radio unit included within timer unit 4. The radio unit within timer unit 4 preferably is capable of communicating over two, four, eight, sixteen or some other number of radio channels for communication with starter unit 2, which preferably is capable of communicating over the same radio channels as is timer unit 4.

As will be described in greater detail in connection with FIGS. 3A and 3B, starter unit 2 operates responsive to button pushes by the starting official, with visual indicators of system state and status provided by the LEDs/lights on starter unit 2, and engages in radio communications with timer unit 4. Timer unit 4 operates responsive to button pushes by the timing official, with visual indicators of system state and status provided by the LEDs/lights on timer unit 4, and engages in radio communications with starter unit 2. Starter unit 2 in turn is operative to start the race or other sporting event.

As illustrated in FIG. 2, timer unit 4 has a video input connected to cable 8 that connects to video camera 6. In preferred embodiments, cable 8 is a standard video cable that connects to timer unit 4 and video camera 6 with standard RCA jacks. In other embodiments; other cabling or communication implements are used to communicate the video information between camera 6 and timer unit 4, including such wired or wireless protocols as USB, wireless USB, HDMI, Bluetooth, Wifi, TCP/IP, etc. What is important is that camera 6 communicates frames of video information from the finish line of the sporting event to timer unit 4.

Also as illustrated in FIG. 2, timer unit 4 also preferably includes a video output connected to cable 10 that connects to computer 16 (preferably a laptop or other portable or desktop computing device). In preferred embodiments, such connection is made via digital converter 12 and cable 14, which preferably are standard video cables that with standard RCA or similar jacks. In other embodiments, other cabling or communication implements are used to communicate the video information between timer unit 4 and computer 16, which may be direct or via an intervening implement such as digital converter 12, including such wired or wireless protocols as USB, wireless USB, HDMI, Bluetooth, Wifi, TCP/IP, etc. In certain alternative preferred embodiments, computer 16 can directly receive, process and display video signals output from timer unit 4. What is important is that timer unit 4 communicates frames of video information, having been processed by timer unit 4 in a manner to be described elsewhere herein, to computer 16.

In accordance with embodiments of the present invention, systems and methods are provided for fully automatic timing for track, swimming or similar racing or athletic events such as boating, driving, cycling, skiing, etc. Starter unit 2 and time unit 4 communicate in a wireless manner, and there is no need to wire starter unit 2. The radio communications may remove the need for an event official to hang out of a press box window or stand on a ladder to raise above the crowd to point a device at the starter. The built-in communications between starter and timing officials and visual indicators of system state status may remove the need to wave flags or hands to indicate that the event officials are ready to proceed with the start of the event. In accordance with the present invention more reliable starts are provided, and there is a reduced need to restart the event because of a poorly aimed device or lack of bright light from a starting device or false premature triggering such as from a spectator's flash camera.

In accordance with preferred embodiments of the present invention, a more affordable video-based system may be provided, for example, with a resolution of about 0.017 seconds, time reported in 1/1000 seconds. Starter unit 2 may be sounded actuated so as to work with, for example, .22 or .32 caliber starting pistols, with no special ammunition required.

Additional operational aspects of preferred embodiments of the present invention will now be described.

Starter unit 2, which is located proximate to the starting official, detects the start of the race when the starting pistol is fired. Starter unit 2 sends a signal to timer unit 4, which starts the race clock. Timer unit 4 is connected to computer 16 and video camera 6. Timer unit 4 receives a live video feed from video camera 6, preferably time stamps each frame of the video signal and passes the video signal on to computer 16 for storage and review. It is important that the starter and timing officials communicate before the start of each race to indicate that they are both ready for the race to begin. Conventionally, this has been accomplished by hand waving or flags. In accordance with preferred embodiments of the present invention, a fully automatic timing system is provided in which such important communication between event officials is integrated into the system. "Ready" buttons and green lights (i.e., ready buttons/lights 1 and 9 of FIG. 1) are used to indicate between the officials that they are ready to start the race. "Stop" buttons and flashing red lights (i.e., stop buttons/lights 3 and 11 of FIG. 1) serve to alert the officials to hold off if the situation warrants.

More particularly, communication between event officials and systems of the present invention is done with push buttons, lights, and sound, which indicate the starting and timing officials' readiness to start the race. There preferably are two light/button combinations on each unit, the green light/ready button and the red light/stop button. The officials communicate with each other by pressing the buttons on their respective starter or timer unit.

The green/ready button is used by either official to signal to the other that they are ready to start the race. The red/stop button is used by either official to signal to the other that they are not ready to start the race, to recall the race or to reset the race clock. The lights and sounds on the units convey the message and indicate the current state of the system, preferred embodiments of which will be further described.

In the "idle state," both lights on the units are off and waiting for an official to signal that they are ready to start the race.

The "are you ready state" is indicated by a green blinking light. This occurs when one official presses the green ready button to signal that they are ready to start the race. The unit will beep twice every 5 seconds on the unit that needs to acknowledge.

The "ready to start race state" is indicated by a steady green light on both units, which occurs when both officials have signaled their readiness to start the race by depressing the ready button.

The "race in progress state" is indicated by steady green and red lights on both units.

The "not ready signal" is indicated by a flashing red light and busy tone.

The "radios not communicating signal" is indicated by a flashing red light and a rapid busy tone. In such event, the start of the race needs to be postponed until communication between the units is established or a backup timer is in place and ready.

As previously described, each of starter unit 2 and timer unit 4 preferably have two buttons, green ready and red stop (see, e.g., buttons/lights 1, 3, 9 and 11 of FIG. 1). In accordance with preferred embodiments, pressing either of these buttons will turn on the respective unit. The green button will turn the unit on and via the radio search for the radio of the other unit. Preferably, a green flashing light indicates that it found the unit, while a red flashing light accompanied by a rapid busy signal indicates that the other unit was not detected. Preferably a press of the red button turns off the flashing lights. Also preferably, the red button will turn on the unit and initiate a check of the battery voltage. In preferred embodiments, the number of beeps from the respective speaker indicates battery strength. For example: 4 beeps may serve to indicated a full battery charge; 3 beeps may serve to indicate a good battery charge; 2 beeps may serve to indicate a fair battery charge (and indicate that the battery charge should be checked again during a long race or event); and 1 beep may serve to indicate a low battery charge (and indicate that the batteries should be charged or changed before the race or event). In preferred embodiments, each unit is powered from a predetermined number of standard rechargeable or non-rechargeable batteries (e.g., 3 AA batteries).

In preferred embodiments, each of starter unit 2 and timer unit 4 are powered off as follows. Each of starter unit 2 and timer unit 4 are powered off by pressing the red button and holding it for a predetermined length of time, such as for 4 seconds. The unit preferably will beep a predetermined number of time, such as 4 times, and then turn off. The radios within each unit will automatically turn off after a period of inactivity. Starter unit 2 will turn off after being in the idle state for a predetermined length of time, such as 10 minutes, and timer unit 4 will will turn off after a predetermined length of time, such as 30 minutes, of the race clock being reset, a button pushed or a light on. Other time out periods and/or sequences are used in alternative embodiments.

The radio units of starter unit 2 and timer unit 4 communicate over a preset radio channel. In some cases, the preselected channel may interfere with other radio operations in the area and the radios may not be able to communicate properly with each other. To verify that the units are communicating, an exemplary operational sequence is as follows. Place the units within a short distance (such as 1-400 feet) of each other, preferably with no obstacles in between the two units. If the units are off, the red buttons on both units may be pressed and a check is made whether the battery charge is acceptable on each unit. A press of the green button on either unit will initiate an attempt to establish radio communications. The green ready light preferably will blink green on both units if the units are communicating properly. A press of the red button on both units to will turn off the lights and reset the units. The red stop light will blink and a rapid busy signal will sound if the unit does not detect the other radio or if the radios are otherwise not communicating properly. If the units are not communicating properly, the units are powered off and a different radio channel is selected. Preferably each unit has a channel selector switch (see, e.g., channel selector switches 5 and 13 of FIG. 1) that can be switched to change radio channels on both units. As described in connection with FIG. 1, the channel selector switch or dial is located on the front of the units, which may be covered by a protective plug to keep the switch from being inadvertently switched or being exposed to dirt, moisture or debris. Preferably the channel selector switch is operated with a small flat head screwdriver or other implement to change the channel and may be recessed to provide space for an optional protective plug. A predetermined number of radio channels preferably are provided, such as 16 in preferred embodiments, which may be numbered 0-9 and A-F. After a change of radio channels to a common channel on both units, the units may be powered back on and the sequence repeated. If a common channel is determined that allows the radios to communicate properly, the green lights flash on both units, and the optional protective plug may be put back into place.

With the radios communicating properly, the units may be setup for the start of an event. Starter unit 2 preferably is positioned on the starting line next to the starting official. The radio unit of starter unit 2 should be located a short distance, such as 1 to 2 feet, from the starting pistol or other sound implement when the pistol or other implement is in its up or ready to fire position. The sound implement can be attached to a starter stand or a tripod, or be held in the starting official's other hand, or attached to the starters arm holding the starting device.

Timer unit 4 preferably is attached to timing/capture computer 16 as previously described. Video camera 6 preferably is located near the finish line and is connected or otherwise in communication with timer unit 4 such as with a standard video cable (as previously described, wireless or other links are used in alternative embodiments to accomplish this connection without a cable, provided that suitable control is provided over the line of site and any interference that may be present). Timer unit 4 acquires the video signal from finish line video camera 6 and passes it to computer 16 optionally through digital converter 12 (see FIG. 2). Desirably, the radios of starter unit 2 and timer unit 4 are in sight of each other or otherwise reasonably free of physical or electronic obstructions in order to communicate properly with each other. The radio signals preferably will travel a substantial distance reliably, such as up to 1000 feet or even 1 mile or more in ideal conditions. The radios preferably transmit through glass windows such as of a press box, which should not impede communication. The radio signals may travel through a wood structure, but should be thoroughly tested before the event. Typically, metal structures may obstruct the radio signals. What is important is that the event is setup so that the starting and finishing locations are arranged so that starter unit 2 and timer unit 4 can communicate reliably in the actual setting of the event.

Starting a race or other event may proceed as follows. Once the runners or other participants are ready, the starting and timing officials must check with each other to establish that they are both ready to start the race. The starting official typically will initiate this exchange by pressing the green ready button on starter unit 2. This sends a "are you ready?" signal via radio communication to timer unit 4. The green lights on both starter unit 2 and timer unit 4 blink, indicating that the starting official is ready and is waiting for the timing official to acknowledge the signal. The receiver unit, in this example timer unit 4, preferably will also beep twice every 5 seconds using speaker 15 (see FIG. 1) to attract the attention of the timing official. The timing official confirms that the system is ready to capture video of the next race by pressing the preferably flashing green button 9 on timer unit 4. This action preferably sends a "yes, I'm ready" signal back to starter unit 2 and the ready lights turn solid green on both units (e.g., switches/lights 1 and 9 of FIG. 1), indicating that both the starting and timing officials are ready for the race to begin. As will be understood by those of skill in the art, the above example shows the starting official initiating this "handshake procedure", but the timing official also may send the "are you ready?" signal to the starting official, in which case the starting official responds by pressing the preferably flashing green button 1 of starter unit 2 when he/she is ready for the race to start.

In preferred embodiments, the starting official has a predetermined length of time, such as 5 minutes, to start the race once the units are in a ready-to-start state and the ready light turns steady green. The race clock in preferred embodiments starts when the starter fires the starting pistol or other sound implement. Once the race clock starts, the red and green lights (e.g., switches/lights 1, 3, 9 and 11 of FIG. 1) preferably are illuminated on both starter unit 2 and timer unit 4, providing a visual indication that the race is in progress and timer unit 4 is running. The race in progress state also may be indicated by a predetermined tone or sound from speaker 7 and/or speaker 15. The lights on timer unit 4 preferably will remain on for the duration of the race. In preferred embodiments, the lights on starter unit 2 will remain on for a predetermined length of time, such as 20 seconds, after the race begins. The starting official may recall the race in this time frame and reset the units to their ready state. After the predetermined time, the lights on starter unit 2 preferably turn off to conserve the batteries and only the timing official can stop the race clock. The timing official presses red stop button 11 on timer unit 4 (see FIG. 1) when the last runner crosses the finish line. This stops and resets the race clock and sets timer unit 4 to the idle state.

In preferred embodiments, both the starting official and the timing official may abort the process at any time before the starting pistol is fired by pressing the red stop button (e.g., buttons/lights 3 and 11 in FIG. 1). This will send a "not ready" signal to the other unit causing it to sound a busy signal and flash the red light. The flashing light and sound will stop after a predetermined length of time, such as 10 seconds, or when the red stop button is pushed.

Also in preferred embodiments, one of the officials has a predetermined length of time, such as 5 minutes, to respond after the other official presses the green button, otherwise the units will time out. When an official presses the green ready button, the green lights preferably blink on both units. If the other official does not acknowledge the signal by pressing a button within the predetermined time, e.g., 5 minutes, both units will give off the "not ready" signal (i.e., flashing red light and busy tone) and then return to the idle state. In such event, one of the officials must reinitialize the "are you ready?" signal before continuing. Likewise, the starting official has the predetermined time, such as 5 minutes, to start the race once the ready light turns solid green. Preferably the green light will blink rapidly on one or both units and one or both units will start beeping for the last, e.g., 30 seconds of the time period to indicate that the system is about to abort. This is a signal that the starting official only has a few seconds to start the race with re-initializing. In preferred embodiments, the starting official is recommended to abort the process by pressing the red stop button. This helps ensure that the starting official has enough time to adequately start the race and that the timing official is ready.

In a typical race or other athletic event, it is important to give either the starting official or the timing official the capability to abort or recall the event, such as in the occurrence of an unfair or "false" start by one or more participants. After the race starts, the starting official may press the red stop button (e.g., button/light 3 of timer unit 2 in FIG. 1) to recall the race up to a predetermined time, such as 20 seconds, after the race begins and when both the red and greens lights are on. This will reset the race clock and restore both units to the ready to start race state (e.g., solid green lights on both units). The starting official preferably then has a period of time, such as 5 minutes, to restart the race before the units time out. In preferred embodiments, the officials must reinitiate the "handshake" procedure if the starting official does not press the red stop button within the recall period or if the units timeout before the restart. Also in preferred embodiments, a predetermined tone or sound is emitted for a predetermined length of time, such as 5 seconds, from speaker 7 and/or speaker 15 to indicate that the race has been recalled.

In preferred embodiments, the race clock will start once the units are in the ready to start race state and starter unit 2 detects the vibrating sound waves from the starting pistol or other sound implement. Starter unit 2 may mistakenly pick up the vibration of other sounds or from starter unit 2 being bumped and inadvertently start the race clock. The units will beep and the green and red lights will be on when this occurs. The starting official can press the stop button within 20 seconds if he/she suspects that this has occurred and the units will go back to the ready to start race state. Otherwise, the timing official will need to press the stop button to reset both units.

In preferred embodiments, if a unit is unable to send a signal to the other unit when a green button is pressed, the red light will flash along with a rapid busy or other distinctive sound. This is similar to the busy signal that occurs when an official presses the red button to abort the race. The distinction is that the tones are played differently, such as closer together, and the signal usually occurs immediately after pressing a button. The starting official may test the radio communication whenever the starting official moves to a new starting position on the track or course and before the next race or event. This may be done, as previously described, with a press of the green go button (see, button/light 1 of FIG. 1). If the green light flashes, then this an indication that the radios are communicating properly. A press of the red stop button can serve to let the timing official know that this was only a test. If red button/light 3 on starter unit 2 flashes accompanied by, for example, a rapid busy signal, then this is an indication that the radios are not communicating properly. There are several reasons why the radios may not communicate properly. These include one of the units being turned off intentionally or being timed out to conserve power (the units should be both be confirmed in the on state); the batteries are low on one or both units (the batteries should be checked and replaced or recharged as may be needed); there is an object physically interfering with the radio communication (line of sight is desirable between the two units; there is interference on the radio channel or the units are not set to the same radio channel (see the above description for selecting a different, common radio channel); or the radios are out of range (the radio communication length preferably is 1000 feet or other distance to accommodate the desired length of the events).

Figure 3B:
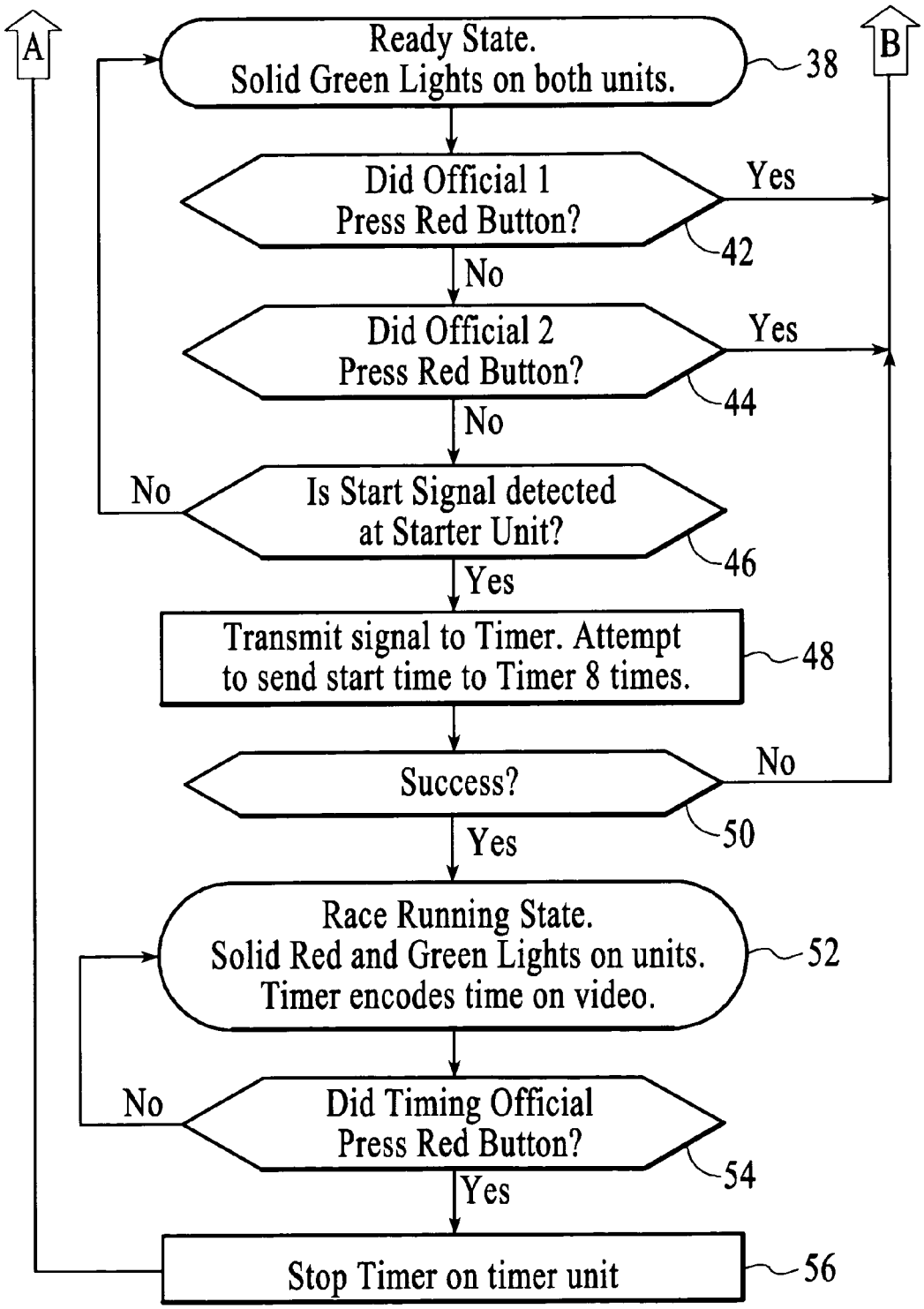

Referring now to FIGS. 3A and 3B, additional methods in accordance with preferred embodiments will now be described.

At step 20, both starter unit 2 and timer unit 4 are in an idle state, preferably with no lights on, and still more preferably in a low power state. At step 22, a determination is made of whether either the starting or timing official activated a green button on the respective starter unit 2 or timer unit 4. If yes, the method proceeds to step 24; if no, the method returns to step 20 to await a green button push. At step 24, a signal is transmitted to the other unit (from radio 1 to radio 2 in FIG. 3A), and lights are preferably blinked on one or both units. As will be understood to those of skill in the art, as may be necessary components of starter unit 2 and/or timer unit 4 exit any low power state as may be necessary to carry out the desired operations. At step 26, both units await either a red or green button push by either the starting official or the timing official (i.e., official 1 or official 2 in FIGS. 3A and 3B, which preferably would be either the starting official or the timing official or vice versa). At step 28, a determination is made whether official 1 pressed the red button; if yes, then the method proceeds to step 40, at which preferably red lights are blinked and a busy signal is sounded on the speakers of both units. If no, then the method proceeds to step 30. At step 30, a determination is made whether official 2 pressed the red button; if yes, then the method proceeds to step 40; if no, then the method proceeds to step 32. At step 32, a determination is made whether official 2 pressed the green button. If yes, then the method proceeds to step 34; if no, then the method returns to step 26. As will be understood, such steps establish a handshake procedure between the two official to confirm the status at the both the starting locations and the finish location prior to proceeding with the method. Such radio-based handshaking offers significant advantages in such preferred embodiments.

At step 34, a signal is transmitted to radio 1, and an attempt is made to synchronize the clocks a predetermined number of times, such as 8 times. As will be described in greater detail elsewhere herein, starter unit 2 and timer unit 4 both include real time clocks (RTCs) that are synchronized in step 34. At step 36, a determination is made whether the RTCs of the two units have been successfully synchronized; if yes, then the method proceeds to step 38; if no, then the method proceeds to step 40. At step 38, the units are now in a ready state awaiting start of the race or other event. Step 38 preferably is indicated by solid green lights on both units, which may be accompanied by a sound from the speakers indicative of the ready state.

After step 38 of FIG. 3B (which generally represents the same state as step 38 of FIG. 3A), the method proceeds to step 42, at which step a determination is made whether official 1 pressed the red button, indicating the start of the race is to be aborted. If yes, then the method proceeds to step 40; if no, then the method proceeds to step 44. At step 44, a determination is made whether official 4 pressed the red button, indicating the start of the race is to be aborted. If yes, then the method proceeds to step 40; if no, then the method proceeds to step 46. At step 46, a determination is made whether a start of race signal has been detected. As discussed elsewhere herein, such start of race may be acoustically detected (e.g., detection of the vibrations from the firing of a starter's gun or other sound implement), or may alternatively be detected by a button push (which could be part of the starter's gun or sound implement, as examples). What is important is that, at step 46, the start of the race or other event is detected. If the determination is yes at step 46, then the method proceeds to step 48; if the determination is no at step 46, then the method returns to step 38.

At step 48, a signal is transmitted to timer unit 4 from starter unit 2. In preferred embodiments, an attempt is made to transmit, based on the synchronized RTCs, the start time of the race to timer unit 4 a predetermined number of times, such as 8 times. At step 50, it is determined if the transmission of the race start time was successful; if successful, this is signaled from timer unit 4 back to starter unit 2, and then the method proceeds to step 52; if not successful, then the method proceeds to step 40. At step 52, the method is in the race running state, which preferably is indicated by solid red and green lights on both units. As also described elsewhere herein, timer unit 4 encodes the time since the race/event start on frames of the video information received from camera 6, which are then output to computer 16, for subsequent display, under control of software running on computer 16, of video images with displayed race times included on the displayed video frames. At step 54, it is determined if the timing official pressed the red button, indicative of the ending of the race or other event (at which point the method proceeds to step 40). If the timing official has not pressed the red button, the method returns to the race running state of step 52. As previously described, at an early point in the race, the starting official also may hit the red button to recall the race, at which time the method would proceed to step 40 (the starting official recalling the race, such as in the event of a false start, is not expressly shown in FIG. 3B but should be understood to be a part of preferred embodiments of the present invention. In the event of race recall, the timing official also may press the red button on timer unit 4 to stop the timer in timer unit 4, with captured video images either discarded or disregarded by the operator of computer 16. In the event of successful race completion, the operator of computer 16 may review and analyze the video images to determine the winners of the race, with the elapsed race time displayed on the video images. In preferred embodiments, the elapsed race time is encoded (not in humanly recognizable form) in a predetermined line of the video image (e.g., line 22), and software running on computer 16 extracts the encoded time and converts it into human recognizable digits. Of course, as will be understood by those of skill in the art, software running on computer 16 may store, process, analyze and display race results and times in any desirable manner.

More specifically, video camera 16 records the runners, swimmers, etc., as they cross the finish line. Timer unit 4 encodes the race time on each frame of the video and the video and times are displayed on computer 16 under software control. The computer operator can capture video through the race or can start capturing the video when the first participant approaches the finish line. Only the relevant video needs to be captured and stored on the computer 16's hard drive. The video is available for review at the end of each race. The review official may advance the video to the frame that shows the runner's torso on or over the finish line to determine the athlete's time.

Preferably, the software running on computer 16 may exchange data with other meet management software applications, including Hy-Tek Meet Manager, Sydex's Track Gold, Easy Meet Manager, TrackMate and Apple Raceberry Jam. In such embodiments, the software preferably displays the list of seeded athletes in the event. The review official preferably clicks on the runner's name or lane in the list and the time is recorded automatically. When all runners are recorded, the results can be transferred to a desired meet management application program with a click of a button. The software preferably can work with one, two or three computers. One computer is sufficient when you have adequate time between races for one person to review the video and record the times. If a meet management programs is utilized, then preferably two or three computers are networked together. With three computers, one computer may be dedicated to capturing the video, one for playback and review and one for scoring with the meet management application. As soon as a race is recorded and saved on the capture computer, the video file preferably appears on a list or queue of captured videos on the review computer. The capture computer is free to record the next race while the review official reviews the video on the playback computer. The operator of the meet management application typically spends most of the time entering results from the field events into the meet management application. The finish line judge preferably notifies the meet management operator when all times from a race are recorded and saved. The meet management operator preferably loads the times into the meet management application with one mouse click and the race is scored. These timing computers in general can be located in any desired location around the track or other venue. The one requirement is that the radio units are able to communicate. As previously described, line of sight is best, but the radio units preferably are capable of finding a path around some obstructions. In most setups, the computers are located either at the base of the video camera or in a press box. In a typical high school setting, where the press box is on top of the stadium and the finish line is next to the stands, around 200-300 ft of cable typically may be required to connect the video camera to the computer in the press box.

Figure 4:
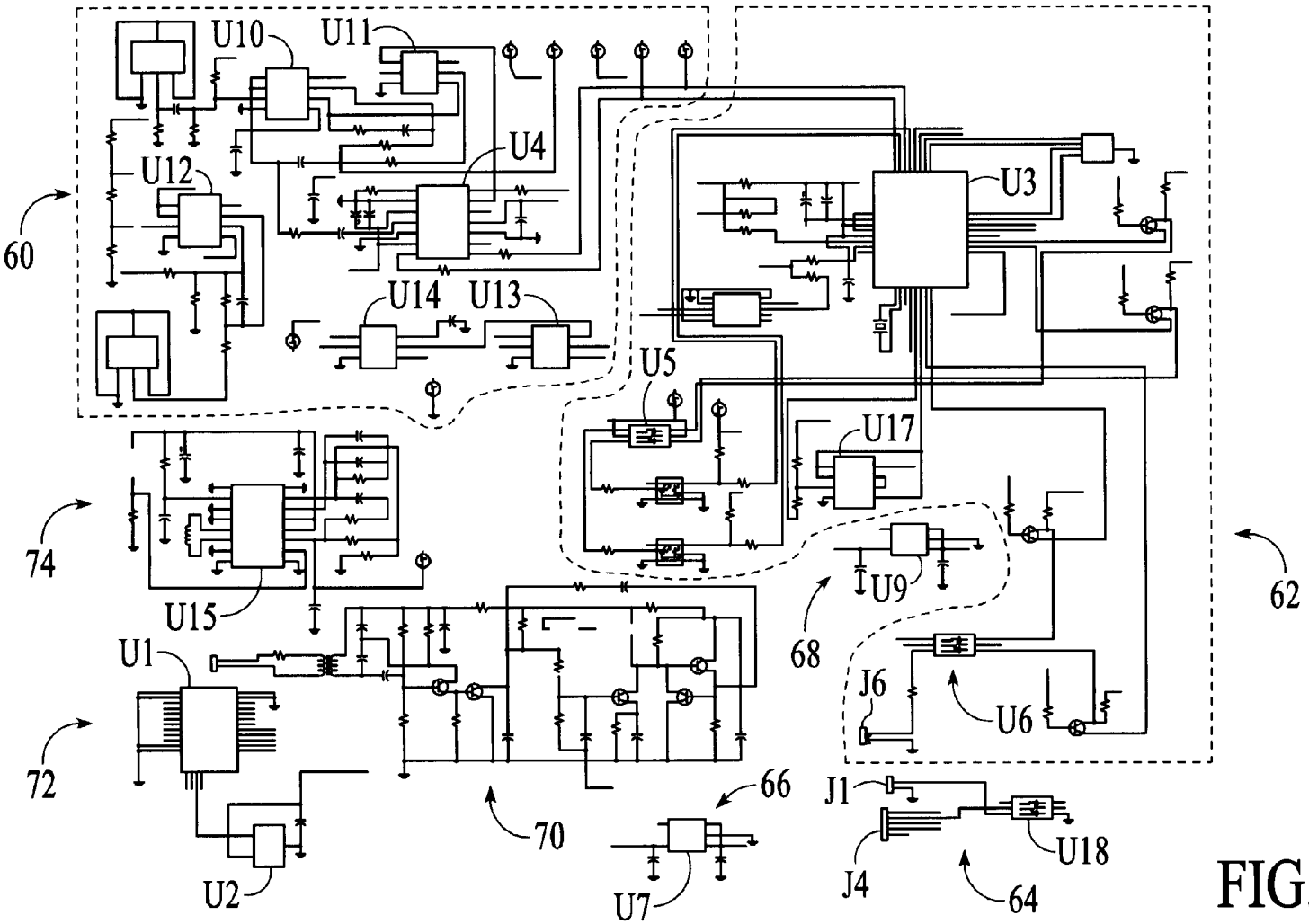
FIG. 4 illustrates exemplary circuitry blocks and circuits in accordance with preferred embodiments of the present invention.

Referring now to FIG. 4, exemplary circuitry blocks and circuits in accordance with preferred embodiments of the present invention will now be described. As will be understood by those of skill in the art, in accordance with embodiments of the present invention alternative circuits and components may be used to implement inventions described herein. And while product literature and data sheets of illustrated exemplary components are hereby incorporated by references, in alternative embodiments other components and circuits are utilized.

Circuit block 60 generally refers to a video circuit, preferably only utilized in timer unit 4. Input J2 represents a video input, such as from camera 16, the input signal of which is coupled to U10, which preferably is a LTC 6241 dual CMOS op amp, believed to be commercially available from Linear Technology Corporation, the data sheet and other technical information from Linear Technology are hereby incorporated by reference. Incoming video preferably is AC coupled to the input (U10.3) of an op amp in U10 preferably configured as a voltage follower with an average voltage of Vsleep/2. The follower output, Unclmp, preferably is AC coupled through C23 to Clmp. V(Clmp) is periodically back-porch sampled by analog switch, U11. That sampled voltage is compared with a reference voltage, VSbk. by the op-amp Q10*b*. Since U11 only conducts during back-porch time the circuit acts to drive the back-porch voltage to equal that of Vsbk. VSbk (and VSwh, which is discussed later) are set by a voltage divider, R29, R30, and R28. U11 preferably consists of a commercially-available ADG779, CMOS, SPDT switch/2:1 Mux, the data sheet and commercially available technical information for which are hereby incorporated by reference.

V(Clmp) is fed to another voltage follower, U12A to produce a buffered output. V(Buffered) is fed to one side of the analog switch, U13. The alternate input to U13 is the output of U14 which, by alternating between VSbk and VSwh, generates the bit pattern to be inserted according to V(WFM). As will be appreciated based on other disclosure herein, such bit pattern may be used to encode elapsed race time into (preferably) each frame of video information captured by camera 16. U13, according to V(INSERT), selects between the clamped and buffered video signal and the bit pattern generated by U14. Under control of CPU U3 (see block 62), which also incorporates the real time clock discussed elsewhere herein, the elapsed race time may be encoded into the video signal. The output of U13, V(Muxed), preferably is applied to a 2× amplifier consisting of U12B (U12 also consists of a commercially-available LTC 6221 dual op amp, which also may be from Linear Technology) and the associated components to produce the signal gain and offset needed to back-terminate the output.

Sync information preferably is extracted from the unclamped signal by U4, a special-purpose integrated circuit that extracts frame, field, H sync and back porch information from the signal. In preferred embodiments, U4 consists of a LMH1981 Multi Format Video Sync Separator from National Semiconductor, the data sheets and commercially technical information for which are hereby incorporated by reference.

By way of further background information, which is known to those of skill in the art, back porch typically refers to a portion in each scan line of a video signal between the end (rising edge) of the horizontal sync pulse and the start of active video. Such portion of a video scan line may be used to restore the black level (300 mV.) reference in analog video. In signal processing terms, it compensates for the fall time and settling time following the sync pulse. In color TV systems such as PAL and NTSC, the back porch also may include the colorburst signal. Such general video concepts are known to those of skill in the art.

More generally, circuit block 60 illustrates exemplary circuitry for inputting a video signal from camera 16 into timer unit 4, and encoding the race time into frames of the video signal under control of CPU U3. In alternative embodiments, other circuits and components are used.

Power generation and management will now be further described. Preferably, the power source in preferred embodiments consist of standard rechargeable or non-rechargeable batteries, such as 3 or a different number of AA size battery cells. Preferably, shunts are provided on the PCB (at J4) that allow either directly powering the unit (starter unit 2 or timer unit 4) from the batteries, or from a switcher connected to the batteries. See circuit 74 and U15 for an exemplary switcher circuit. Switcher circuit preferably is a LTC3534-7V, 500 mA Synchronous Buck-Boost DC/DC Converter (the data sheets and commercially available technical information for which are hereby incorporated by reference), which serves to buck or boost the voltage to provide a switcher output voltage SW Out (which may be tested at test point J16). Alternatively, if the switcher is not used, the minimum cell voltage may be, for example, 1.25V, meaning that non-rechargable alkaline or lithium cells preferably should be used. If the switcher is used, preferably starter unit 2 and timer unit 4 will tolerate cell voltages down to about 1V. Switcher selection preferably is accomplished through changing the positions of the shunts located at connector J4 of circuit block 64. If the shunts bridge J4.1-2 and J4.3-4, the switcher acts to buck or boost the battery voltage as appropriate. When the shunts bridge J4.2-3 and J4.4-5, the battery drives the series regulators, U7 and U9 (circuits 66 and 68) directly. Preferably, the output voltage provided by U7 and U9 is nominally 3.3V. To extend battery life, the source voltage applied to U7 (which regulates VSleep) preferably is switched off in standby mode, while U9 always supplies Vcc to the processor and the start-up circuit (see circuit block 62).

As will be appreciated by those of skill in the art, circuit block 72 generally refers to a radio unit used in both starter unit 2 and timer unit 4.

Referring now to circuit block 70, an exemplary trigger arrangement used in preferred embodiments will now be described. Circuit block 70 preferably only exists in starter unit 2. Starter unit 2 preferably is triggerable in two ways. The first is through an acoustic mechanism. A small loudspeaker connected via J6 of circuit block 62 is used as a microphone which will generate a pulse in response to the sound from a starting gun or other sound implement. This pulse preferably is AC coupled to Q6, which has a quiescent current of less than 10 uA. In addition to the AC coupling through C37, additional high frequency sensitivity is provided by C34, located in the emitter circuit of Q6. In the absence of an input signal Q10 typically has less than 100 mV of forward bias. However, based on the diode equation, the emitter current increases by a factor of 10 for each 60 mV of additional forward bias. Thus, and without being bound by theory, a 60 mV signal is large enough typically to cause Q10 to conduct. This activates the positive feedback loop formed by the path through Q11, causing V(Out) to drop from about 3V down to less than a volt, discharging C39 to below the threshold voltage needed to trigger an interrupt at P0.2 of CPU U3 of circuit block 62 (the signaling to CPU U3 of the start of the race preferably is by interrupt to CPU U3, which is detected on an interrupt line of CPU U3. What is important is that a circuit is provided that can detect the sound impulse from the starter's gun or other sound implement and generate a signal that can be coupled to CPU U3 so as to signal the start of the race and carry out corresponding operations as described elsewhere herein.

The second mechanism of triggering an interrupt or other start indicative signal to CPU U3 is through recognizing a contact closure. Preferably, Q8 functions as what is known as a Colpitts oscillator, using one winding of T1 and C31 and C32 as a tank circuit. Q8 preferably drives the tank circuit with relatively narrow current pulses, causing Q5 to C34 to ground every cycle. However, if a low resistance is applied to J21.1-2, oscillation stops, causing C30 to rise almost to V(VSleep). That rising voltage is differentiated by C38 and R72, turning on Q11. Positive feedback through Q10 trips the one-shot similarly to the way it is triggered in the first case. Note also that when the oscillator stops, Q5 is conducting only very slightly, causing the junction of R56 and R65 to rise almost to V(VSleep), causing the sensitivity of the acoustic trigger to increase. If the contact closure is not desired, the oscillator should be stopped. Therefore the connection to J21 should be through a shorting jack to ensure that the acoustic input behaves properly when contact closure detection is not wanted. What is important is that a circuit be provided that allows a contact closure, such as via a push button switch or the like, that serves to signal to CPU U3 that the race has started.

Also as will be appreciated by those of skill in the art, Vbat S is generated by U6, which preferably is a dual MOSFET circuit, commercially available and known in the art as a FDC6318A, the data sheets and commercially available information for which is hereby incorporated by reference. Side 1 of U6 preferably serves to control speaker attached to J6, which side 2 is used to generate V Bat S (switched battery voltage). V Bat S preferably is used via U7 to generate VSleep, while Vbat is used by U9 to generate Vcc. As will be appreciated by those of skill in the art, having two supply voltages, VSleep and Vcc enable a full power operating mode and a lower power operating mode in which only selective components are powered, thereby enabling reduced power consumption. U7 and U9 preferably are LP3990, which are commercially available components, data sheets and commercially available information for which are hereby incorporated by reference. A further exemplary description is that such low power mode may be detected by CPU U3 via detecting button pushes (see S1 and S2 of circuit block 62, which illustrate exemplary buttons/LEDS used for buttons/lights 1, 3, 9, and 11 of FIG. 1). As will be appreciated by those of skill in the art, button pushes may be detected on signal lines P 0,1 and P 0,3 of CPU U3, which preferably may be lines programmed as interrupt lines when in low power or sleep mode, but which may be programmed as I/O lines in full power mode and then periodically polled by CPU U3 in order to carry out the operations described elsewhere herein.

Op amp 1 of U17 of circuit block 62 is an exemplary circuit (LTC6241 such as previously described) that provides a reference voltage that may be used as an analog input to CPU U3, which can read the resistive divider-generated reference voltage to determine the state of the batteries such as described elsewhere herein. As will be appreciated by those of skill in the art, CPU U3 may have pins programmed to receive analog voltages, which may be input to an analog to digital converter in CPU U3 that enables the battery voltage to be monitored (controlled by P 2, 3 and read by P 2, 2 of CPU U3).

As will be appreciated, the circuits and circuit blocks of FIG. 4 are exemplary only and used in certain preferred embodiments, while in other preferred embodiments other circuits may be used to carry out the functions and operations as described elsewhere herein.

Further aspects of hand shaking and clock synchronization used in preferred embodiments of the present invention will now be further described.

The radio system used in preferred embodiments (described elsewhere herein) for automatically timing race events consists of two units: starter unit 2 and timer unit 4. It is important that the real time clocks (RTC's) of these two units be synchronized. Preferred embodiments include a "handshaking" process describe earlier to indicate that both the starter and timing officials are ready to start the race. During this process, starter unit 2 and timer unit 4 preferably have their real time clocks (RTC) synchronized.

Synchronization preferably starts when timer unit 4 sends a start synchronization command to starter unit 2. Starter unit 2 preferably returns an acknowledgment and immediately sets its RTC to a number that will reach zero when sufficient time has lapsed for timer unit 4 to receive the acknowledgment signal. Timer unit 4 preferably sets its RTC to zero when it receives the starter's acknowledgment signal. The synchronization between timer unit 4 and starter unit 2 is then verified to ensure they are within an acceptable tolerance of, preferably, +−3 micro seconds. In alternative embodiments, for example, such synchronization between the timer unit 4 and starter unit 2 is plus or minus a different time, such as 183 micro seconds, which preferably is plus or minus a number of CPU or other clock cycles, such as 6 clock cycles in alternative preferred embodiments.

Without being limited to particular numeric values, in preferred embodiments, the time necessary for the transmission between the units and the RTC's initialization has been empirically characterized for the preferred radio units and in the exemplary embodiments is 191/32768 seconds. This number resulted from field trials of the radios separated by as little as 2 feet and as much as 300 feet. The variance from these tests averages 100 micro seconds with a standard deviation of a fifth of that number. The accuracy required for fully automated timing generally is considered around 10 milliseconds.

In preferred embodiments, the synchronization process is repeated if there are any transmission failures or error in the verification. If the units cannot be synchronized after a predetermined number of tries (8 in the preferred embodiment) an alarm is raised at both units and the starting official knows not to start the race. If the RTCs in the units are synchronized, the starting official is given the "ready" signal to start the race. At the start of the race, starter unit 2 transmits the start time to timer unit 4. Error detection information preferably is included in the message so timer unit 4 can detect bad data and request a retransmission if needed. Seconds are available for this transmission since the shortest race commonly found is the indoor track meets for example is 60 meters in about six seconds and the 100 meters in about 10 seconds.

Preferred embodiments of the present invention have advantages over a method that only transmits a signal corresponding with the start instant when the race starts. This is so because the signal could receive interference and would need to be retransmitted. This would cause an error in the race time.

Additional alternative preferred embodiments will now be described.

As previously described including in connection with FIG. 1, starter unit 2 preferably includes speaker 7 for emitting sounds to the starting official. Starter unit 2, in combination, for example, with certain circuits of FIG. 4 as previously described, can detect acoustically the sound from a starter's gun or other sound implement to detect the start of the race. In alternative embodiments, however, circuits of FIG. 4 are integrated into the starter's gun or other sound implement for signaling the start of the race or other event.

Figure 5:
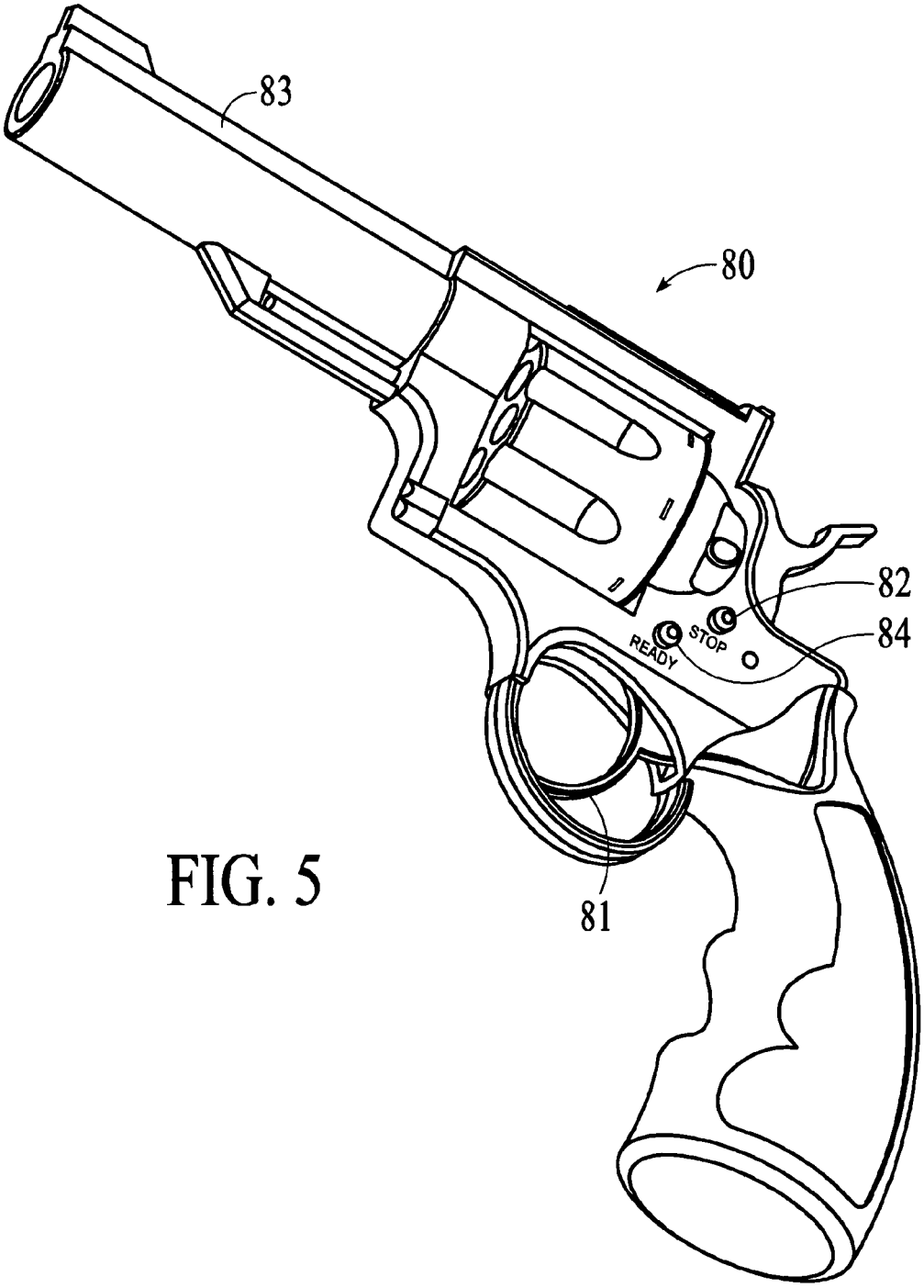
FIGS. 5 and 6 illustrate alternative embodiments of the present invention with a sound implement is integrated with a starter unit, and/or with video interpolation.

FIG. 5 illustrates an alternative preferred embodiment in which the circuits of the starter unit are integrated into a sound implement shaped like a starter' pistol or gun. Integrated unit 80 is illustrated in the shape of a gun, but it should be understood that such an integrated unit could be shaped in other forms, such as the more rectangular shape of starter unit 2 in FIG. 1. What is important is that the sound element for signaling the start of the race is integrated with the other electronics of the starter unit so that the same action as signaling the start of the race to the participants with sound either acoustically or electrically signals to CPU U3 of FIG. 4 that the race has started. In the embodiment illustrated in FIG. 5, ready button/light 84 is provided, which functionally and structurally may be the same as or similar to button/light 1 of FIG. 1, and stop button/light 82 is provided, which functionally and structurally may be the same as or similar to button/light 3 of FIG. 1. Trigger 81 is provided to initiate sound generation, which in preferred embodiments may be coupled to J21.1-2 as described in connection with FIG. 4 (contact closure method of triggering). As will understood by those of skill in the art, trigger 81 may be used to close such contacts and signal to CPU U3 that the race is being initiated, and thus the sound implement should triggered to emit the sound for signaling the event participants that the event is under way. A sound emitting implement, which may be made to emulate a gun shoot, horn, whistle or other desired sound, may be audibly triggered by CPU U3 in response to the contact closure much in the manner that the speaker illustrated as may be connected to J6 of circuit block 62 is activated under control of CPU U3. What is important is that the trigger or other button, switch, lever, etc. of the integrated unit signal to the circuitry of the start unit that the event is to start so that the sound may be emitted to the participants and so that the race time, etc., and other signaling and processing as described elsewhere herein between start unit 2 and timer unit 4 may be carried out. In the illustrated embodiment of FIG. 5, antenna 2A of FIG. 1 may be integrated as part of gun barrel 83, although other forms of antenna implementation are used in other such integrated embodiments.

In addition, the present invention is not intended to be limited to any form of signaling of the race start from the sound implement to CPU U3. Such sound implement could be, for example, a gas discharge or separate electrical unit that emits sound, such as by activation of trigger 81 of FIG. 5, with the resulting sound acoustically detected in the manner as previously described. Such variations are contemplated to be within the scope of the present invention.

In connection with the embodiments described previously herein, in certain preferred embodiments, the time necessary for the transmission between the starter and timer units and the RTC initialization has been empirically characterized. In alternative embodiments, such unit-unit transmission time settings may be adjusted in software. Such settings may be made, for example, via control settings available to a supervisor type use of the software running on the review computer. In one such embodiment, the control settings are available only under supervisor access and supervisor password control, and the settings are made, for example, by setting a time value or by setting a distance value which is used to scale or otherwise compute a value based on a previously stored value (e.g., a time value). In yet other alternative embodiments, a similar adjustable setting is made available in the review computer to adjust for distance between the sound implement for starting the race and the circuit in starter unit 2 for acoustically detecting the start of the race. In such other embodiments, which again are preferably under supervisor control and password protected, a value may be set to accommodate different distances between the sound implement and the start unit, which may be made, for example, for setting a time value or by setting a distance value which is used to scale or otherwise computer a value based on a previously stored value (e.g., a time value). What is important in such alternative embodiments is that settings are available, preferably under software control and preferably with restricted access, that enable the system to time events easily and accurately and having improved capability to accommodate different distances between the starter unit and the timer unit, and/or different distances between the sound implement (e.g., starter's gun) and the timer unit.

In accordance with the present invention, other desirable user features may be provided under software control, such as one or more computer received video information from timer unit 4. An illustrative user guide (Flash Timing for FT-FAT and Pyro Bright Flash User Guide Version 2.0) is being made of record herewith and is hereby incorporated by reference. Such subject matter of this incorporated-by-reference user guide in within the scope of the present invention.

In addition, certain illustrative components are shown in FIG. 4 and used in preferred embodiments. Publicly available information for such illustrative components, such as technical information and data sheets, are hereby incorporated by reference.

In yet other alternative preferred embodiments, video or frame rate conversion or interpolation is used to increase visual and time resolution for timing athletic-type events. As is know to those of skill in the art, video information may be interpolated to calculate frames intermediate to frames generated by the video camera. One such frame rate conversion-type technology is produced by YUVsoft corporation, publicly available information for which is hereby incorporated by reference. Preferred embodiments use such commercially-available frame rate conversion or frame interpolation software to provide additional capability in accordance with the present invention.

Figure 6:
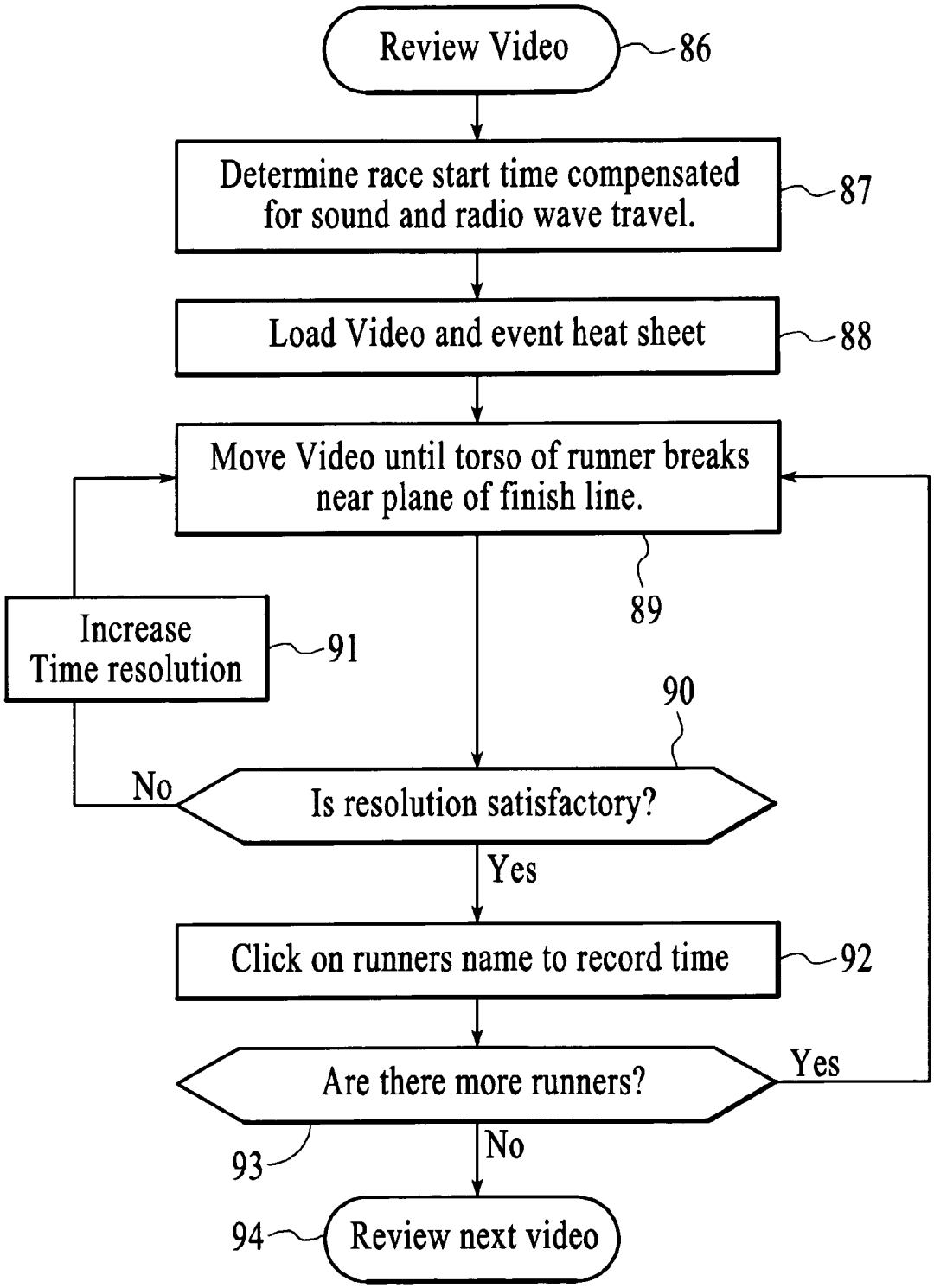

Such frame rate conversation software receives video frames and may interpolate one or a plurality of frames intermediate to two video frames. In certain preferred embodiments, a predetermined number of interpolated frames are selected by software control, and the frame rate conversion or interpolation software calculates or otherwise determines the predetermined number of interpolated frames (e.g., 1 to 9 interpolated frames, providing what is in effect a 2× to 10× conversion factor). FIG. 6 illustrates how such FRC or interpolation software may be desirably utilized in certain alternative preferred embodiments of the present invention.

As illustrated in step 86, review software running on a computer that receives frames of video information from timer unit 4 is accessed by an operator. Such a review computer may be one of several computers receiving such video information from timer unit 4, such as is described elsewhere herein. An operator may access the video information for a race to determine when a particular runner or other event participant crosses the finish line. At step 87, the operator optionally may adjust values via software running on the review computer to compensate for time and distance for radio or sound based travel (between timer unit and starter unit, or between starter unit and sound implement), such as previously described. At such optional step, a race start time may be compensated for differences in distances, etc., as again as previously described.

At step 88, video information received from timer unit 4 may be loaded onto the review computer for analysis. At step 89, preferably the operator of the review computer advances the video frames to determine when, in the example of a runner, the torso of the runner breaks near the plane of the finish line. At step 90, the operator desirably determines if the video frames as provided from timer unit 4, provides adequate resolution for determining the participate finish place or time. If the determination is yes, then the method proceeds to step 92. If the answer is no, then the method proceeds to step 91.

At step 91, in alternative preferred embodiments an increase in the video frame resolution, and accompanying time resolution, is provided by frame rate conversion or interpolation software preferably also running on the review computer. In one example, the operator may select a first level of interpolation, such as a single interpolated frame, and in such event an interpolated frame is provided, and an interpolated finish time is provided. Preferably, such interpolation of the video and time information is by linear interpolation, but other types of interpolation are within the scope of the present invention. After one or more interpolated frames of video and accompanying time information are provided, the operator may repeat step 89. As before, if the determination is yes, then the method proceeds to step 92. If the answer is no, the method preferably returns to step 91 and a higher degree of interpolation, with increased video and time resolution, is provided. As will be understood, such steps repeat as may be necessary for the video operation to determine participant finish and time based on the video information provided by timer unit 4. With such embodiments, operator control determines whether interpolation is used, and the degree of interpolation, based on the particular race results.

At step 92, with adequate resolution as determined by the review computer operator, the video frame (as generated by timer unit 4 or an interpolated frame) may be selected along with a participant identifier (e.g., name or number), so that the results for that participate may be recorded or otherwise captured and saved. At step 93, the method may return to step 89 for other participants in the event so that their respective places and times may be recorded, etc. At step 94, with all results for the participants having been determined from the preceding steps, a video for a subsequent or other event or race may be accessed in the review computer for similar analysis.

What is important is that, within the scope of the present invention, frames of video information may be selectably interpolated under software control on the review computer, so that the operator of the review computer may selectively increase the video and time resolution in a manner to determine event results and timing with improved resolution.

Although the invention has been described in conjunction with specific preferred and other embodiments, it is evident that many substitutions, alternatives and variations will be apparent to those skilled in the art in light of the foregoing description. Accordingly, the invention is intended to embrace all of the alternatives and variations that fall within the spirit and scope of the appended claims. For example, it should be understood that, in accordance with the various alternative embodiments described herein, various systems, and uses and methods based on such systems, may be obtained. The various refinements and alternative and additional features also described may be combined to provide additional advantageous combinations and the like in accordance with the present invention. Also as will be understood by those skilled in the art based on the foregoing description, various aspects of the preferred embodiments may be used in various subcombinations to achieve at least certain of the benefits and attributes described herein, and such subcombinations also are within the scope of the present invention. All such refinements, enhancements and further uses of the present invention are within the scope of the present invention.

What is claimed is:

1. A system for timing an athletic event, comprising:

a starter unit including a first radio unit, a first user-operable switch interface, a first user-visible output interface and first processing circuitry providing a first real time clock;

a timer unit including a second radio unit, a second user-operable switch interface, a second user-visible output interface and second processing circuitry providing a second real time clock, wherein the second radio unit, second user-operable switch interface, second user-visible output interface and second processing circuitry providing the second real time clock are different from the first radio unit, first user-operable switch interface, first user-visible output interface and first processing circuitry providing the first real time clock, respectively;

a camera coupled to the timer unit and providing video information to an input of the timer unit;

wherein an operator of the starter unit exchanges commands with an operator of the timer unit via the first user-operable switch interface, wherein the starter unit and the timer unit exchange information to synchronize their respective first and second real time clocks, wherein an indication is provided by each of the first and second user-visible output interfaces that the event is ready to be started, wherein the first processing circuitry of the starter unit detects the start of the event and subsequently sends information indicative of a race start time to the timer unit, wherein the timer unit outputs video frames that encode information indicative of an elapsed race time in the output video frames;

wherein the starter unit is integral with a sound implement that generates sound indicative of the start of the event.

2. The system of claim 1, wherein the starter unit and the timer unit are operable so that either the operator of the starter unit or the operator of the timer unit initiates the generation of a first signal that is received by the other of the timer unit or the starter unit, respectively, that indicates to the operator thereof that the operator initiating the generation of the first signal is ready for the event to be started.

3. The system of claim 2, wherein the starter unit and the timer unit are operable so that, subsequent to receiving of the first signal by the other of the timer unit or the starter unit, the operator of the other of the timer unit or the starter unit initiates the generation of a second signal that is received by the starter unit or timer unit, respectively, and indicates to the operator of the starter unit or the operator of the timer unit, respectively, that the operator initiating the generation of the second signal also is ready for the event to be started.

4. The system of claim 3, wherein the starter unit and the timer unit are operable to concurrently display inform5tion on both the starter unit and the timer unit that is indicative to both of the operators of the starter unit and the timer unit that both operators are ready for the event to be started.

5. The system of claim 3, wherein the starter unit and the timer unit are operable to establish a handshake procedure that confirms whether both operators are ready for the event to be started.

6. The system of claim 2, wherein, subsequent to the generation of the first signal, the starter unit and the timer unit are operable to exchange clock synchronization signals for synchronizing the first real time clock of the starter unit with the second real time clock of the timer unit.

7. The system of claim 6, wherein a determination is made whether the first real time clock has been successfully synchronized with the second real time clock, wherein, if it was determined that the first real time clock was not successfully synchronized with the second real time clock, the starter unit and the timer unit are operable to exchange clock synchronization signals for synchronizing the first real time clock of the starter unit with the second real time clock of the timer unit one or more additional times.

8. The system of claim 7, wherein the clock synchronization signals comprise:

a start synchronization signal sent from the timer unit to the starter unit; and responsive to the start synchronization signal, an acknowledgment signal sent from the starter unit to the timer unit.

9. The system of claim 8, wherein the starter unit sets the first real time clock to a predetermined value so that the first real time clock will be at or about zero when the timer unit receives the acknowledgment signal, wherein the timer unit sets the second real time clock to zero responsive to receipt of the acknowledgment signal.

10. The system of claim 1, wherein the timer unit outputs video frames that encode information indicative of the elapsed race time in the output video frames in humanly recognizable form or in encoded non-humanly recognizable form.

11. A system for timing an athletic event, comprising:

a starter unit including a first radio unit, a first user-operable switch interface, a first user-visible output interface and first processing circuitry providing a first real time clock;

a timer unit including a second radio unit, a second user-operable switch interface, a second user-visible output interface and second processing circuitry providing a second real time clock, wherein the second radio unit, second user-operable switch interface, second user-visible output interface and second processing circuitry providing the second real time clock are different from the first radio unit, first user-operable switch interface, first user-visible output interface and first processing circuitry providing the first real time clock, respectively;

a camera coupled to the timer unit and providing video information to an input of the timer unit;

wherein an operator of the starter unit exchanges commands with an operator of the timer unit via the first user-operable switch interface, wherein the starter unit and the timer unit exchange information to synchronize their respective first and second real time clocks, wherein an indication is provided by each of the first and second user-visible output interfaces that the event is ready to be started, wherein the first processing circuitry of the starter unit detects the start of the event and subsequently sends information indicative of a race start time to the timer unit, wherein the timer unit outputs video frames that encode information indicative of an elapsed race time in the output video frames;

wherein the system further comprises a computing device for processing video frames from the timer unit;

wherein the computing device, under software control, generates one or more interpolated video frames intermediate to video frames from the timer unit, wherein the interpolated video frames provide a time resolution for determining when a participant in the athletic event crosses a finish line.

12. The system of claim 11, wherein the starter unit and the timer unit are operable so that either the operator of the starter unit or the operator of the timer unit initiates the generation of a first signal that is received by the other of the timer unit or the starter unit, respectively, that indicates to the operator thereof that the operator initiating the generation of the first signal is ready for the event to be started.

13. The system of claim 12, wherein the starter unit and the timer unit are operable so that, subsequent to receiving of the first signal by the other of the timer unit or the starter unit, the operator of the other of the timer unit or the starter unit initiates the generation of a second signal that is received by the starter unit or timer unit, respectively, and indicates to the operator of the starter unit or the operator of the timer unit, respectively, that the operator initiating the generation of the second signal also is ready for the event to be started.

14. The system of claim 13, wherein the starter unit and the timer unit are operable to concurrently display inform5tion on both the starter unit and the timer unit that is indicative to both of the operators of the starter unit and the timer unit that both operators are ready for the event to be started.

15. The system of claim 13, wherein the starter unit and the timer unit are operable to establish a handshake procedure that confirms whether both operators are ready for the event to be started.

16. The system of claim 12, wherein, subsequent to the generation of the first signal, the starter unit and the timer unit are operable to exchange clock synchronization signals for synchronizing the first real time clock of the starter unit with the second real time clock of the timer unit.

17. The system of claim 16, wherein a determination is made whether the first real time clock has been successfully synchronized with the second real time clock, wherein, if it was determined that the first real time clock was not successfully synchronized with the second real time clock, the starter unit and the timer unit are operable to exchange clock synchronization signals for synchronizing the first real time clock of the starter unit with the second real time clock of the timer unit one or more additional times.

18. The system of claim 17, wherein the clock synchronization signals comprise:

a start synchronization signal sent from the timer unit to the starter unit; and responsive to the start synchronization signal, an acknowledgment signal sent from the starter unit to the timer unit.

19. The system of claim 18, wherein the starter unit sets the first real time clock to a predetermined value so that the first real time clock will be at or about zero when the timer unit receives the acknowledgment signal, wherein the timer unit sets the second real time clock to zero responsive to receipt of the acknowledgment signal.

20. The system of claim 11, wherein the timer unit outputs video frames that encode information indicative of the elapsed race time in the output video frames in humanly recognizable form or in encoded non-humanly recognizable form.

21. The system of claim 11, wherein the one or more interpolated video frames is generated based on frame rate conversion.

22. The system of claim 11, wherein the one or more interpolated video frames is generated based on linear interpolation.

23. The system of claim 11, wherein the computing device provides a first level of interpolation of video frames, wherein under operator control the computing device provides a second level of interpolation of video frames, wherein the second level of interpolation of video frames provides a greater number of interpolated video frames compared to the number of interpolated video frames with the first level of interpolation of video frames.

24. The system of claim 23, wherein a degree of interpolation is selectively provided based on particular results of the athletic event.

25. The system of claim 24, wherein the degree of interpolation provides a control time resolution.

* * * * *